United States Patent [19]

Nishioka

[11] 4,365,611

[45] Dec. 28, 1982

[54] COMPOUND BOW WITH UNEQUALLY FLEXING ARMS

[76] Inventor: Jim Z. Nishioka, 1268 Hemlock NW., Salem, Oreg. 97304

[21] Appl. No.: 205,008

[22] Filed: Nov. 7, 1980

Related U.S. Application Data

[63] Continuation of Ser. No. 22,054, Mar. 19, 1979, abandoned.

[51] Int. Cl.[3] ..... F41B 5/00

[52] U.S. Cl. ..... 124/24 R; 124/90; 124/DIG. 1

[58] Field of Search ..... 124/23 R, 24 R, 88, 124/1, 90, 86, 22, 61, 25, 67

[56] References Cited

U.S. PATENT DOCUMENTS 3,486,495 12/1969 Allen ..... 124/24 R 3,967,609 7/1976 Frydenlund ..... 124/24 R 3,989,026 11/1976 Nishioka ..... 124/24 R 3,993,039 11/1976 Groves ..... 124/23 R

OTHER PUBLICATIONS

"Martin"-Archery World, Jan. 1979.

"Dynabo"-Popular Science Magazine, Jan. 1977, p. 90.

*Primary Examiner*—Richard C. Pinkham

*Assistant Examiner*—William R. Browne

[57] ABSTRACT

The bow has a first arm and a second arm, the first arm flexing more than the second arm during drawing movements of the bow, and a pulley on at least one of the arms. A bowstring with a nocking point extends between the arms. The pulley and the bowstring are arranged on the bow so as to maintain the nocking point in substantially the same plane as the arrow shelf in all drawing movements of the bowstring.

7 Claims, 7 Drawing Figures

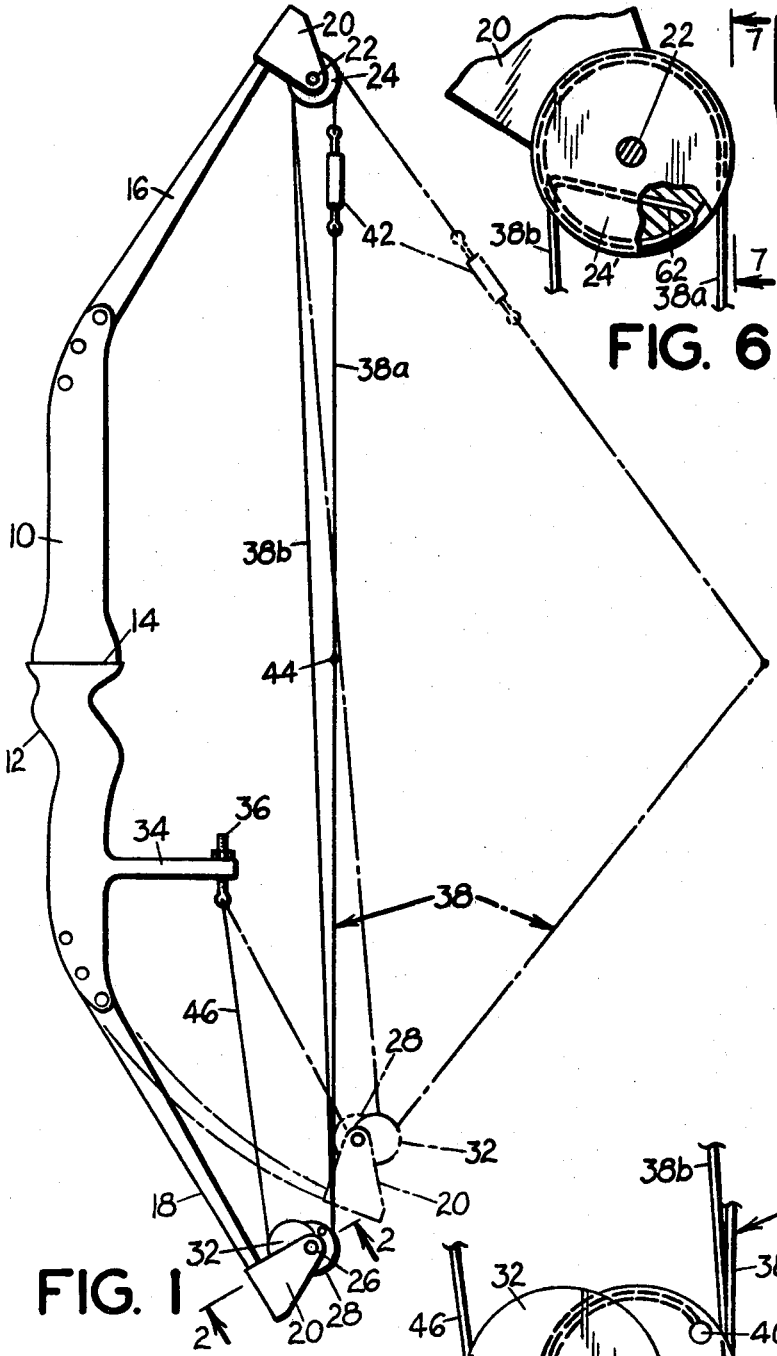
FIG. 1
FIG. 6
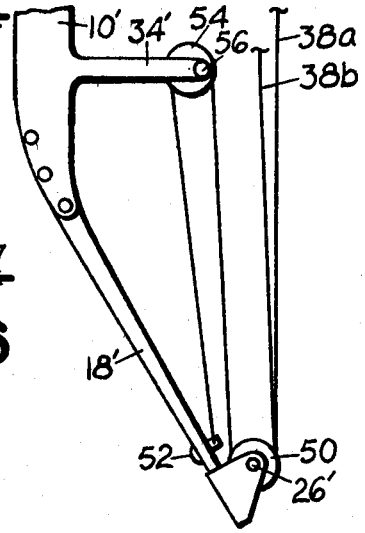
FIG. 4
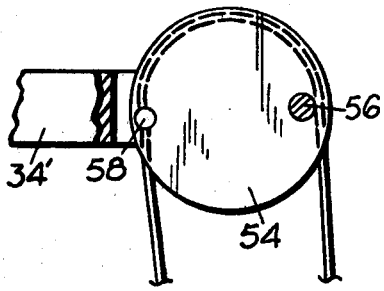
FIG. 5
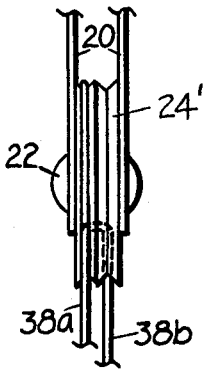
FIG. 7
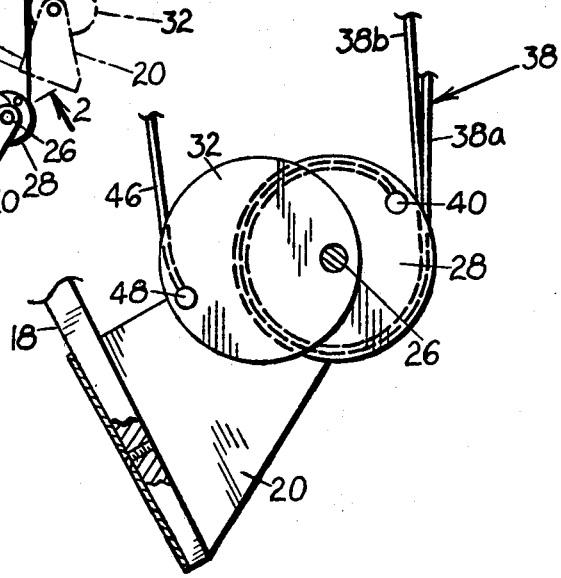
FIG. 3
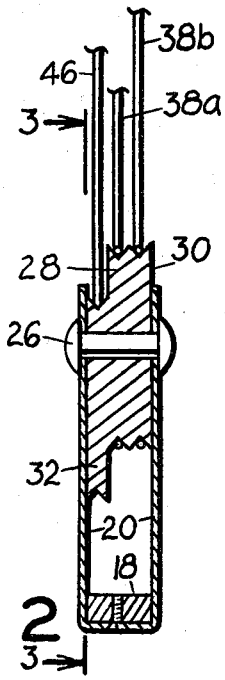
FIG. 2

COMPOUND BOW WITH UNEQUALLY FLEXING ARMS

This application is a continuation of application Ser. No. 22,054, filed Mar. 19, 1979, now abandoned.

BACKGROUND OF THE INVENTION

This invention relates to new and useful improvements in archery bows and is particularly concerned with a compound-type bow wherein tension in the bowstring is varied so as to lessen the drawing force required in final drawing conditions of the bowstring.

Many types of archery bows have been developed for the purpose of increasing energy imparted to the arrow. Also, developments have been made to build a break-over in the drawing force wherein less force is required to draw and hold the bowstring in end drawing positions than in initial drawing positions. These developments have materially increased the complexity of the archery bow and thus such bows are more costly to manufacture. Also, they are more difficult to adjust. Furthermore it is difficult to install a bowstring thereon particularly in the field. In addition, there may be cables, tiller strings or hardware in addition to the bowstring, and these additional components produce a cumbersome product for use or storage. Such extra bow components may also interfere with accurate shooting.

It has been found in the art that the complexity and cost of a bow can be materially reduced by utilizing a first arm that flexes more than a second arm. This arrangement however, has required more complex elements in other portions of the bow in order to balance tension forces operating on the arrow and also to achieve the break-over desired. Thus, the use of an arm which flexes more than the opposing arm has not heretofore materially simplified the bow.

SUMMARY OF THE INVENTION

According to the present invention and forming a primary objective thereof an archery bow is provided that is simplified in construction and at the same time has features which utilize an arrangement of arms and pulley or pulleys whereon one arm flexes more than the other arm; which provide a break-over of the bow to ease off the force required to draw the bow at end drawing positions; and which maintain the nocking point on the same plane as the arrow shelf in all drawing movements of the bowstring.

In carrying out these objectives, the bow is provided with a first arm which flexes more than a second arm. Guide means are mounted on at least one of the arms around which the bowstring is movably guided. Such guide means maintain the nocking point of the bowstring substantially in alignment with the guiding path provided for the projectile by the arrow shelf in all drawing movements of the bowstring. The bow may also include eccentric means operatively connected with the bowstring for providing the break-over in the bow to ease the bowstring tension at the end drawing positions of the bowstring.

The invention will be better understood and additional objects and advantages will become apparent from the following description taken in connection with the accompanying drawings.

BRIEF DESCRIPTION OF THE DRAWINGS

FIG. 1 is a side elevational view of an archery bow employing principles of the present invention, a drawn position of the bow being shown in broken lines;

FIG. 2 is an enlarged fragmentary sectional view taken on the line 2—2 of FIG. 1;

FIG. 3 is a sectional view taken on the line 3—3 of FIG. 2;

FIG. 4 is a fragmentary side elevational view of an archery bow employing a modified form of the invention;

FIG. 5 is an enlarged fragmentary elevational view of break-over means of FIG. 4, a portion of the structure of this view being removed for clarity;

FIG. 6 is a fragmentary side elevational view of a further modification of the invention; and FIG. 7 is an end elevational view of the structure of FIG. 6, this view being taken on the line 7—7 of FIG. 6.

DETAILED DESCRIPTION OF A PREFERRED EMBODIMENT

With reference first to FIGS. 1-3 which show a first form of the invention, an archery bow includes a body portion 10 of the usual construction, such body portion having a hand grip 12 and an arrow shelf 14 which provides a projectile guiding path extending at substantially a right angle to the body portion. A pair of bow arms 16 and 18 extend from the body portion 10 and each of these arms has a rearward turned U-shaped bracket 20 secured thereto. The bracket 20 on the arm 16 supports a shaft 22 for a pulley 24. Bracket 20 on arm 18 has a shaft 26 for a pulley assembly comprising a pair of pulleys 28 and 30 of similar diameter and an outer pulley 32, these three pulleys being rotatable as an integral unit. Such pulley assembly may comprise three pulleys secured together or it may be cast as one piece as shown. Pulleys 28 and 30 are concentrically supported on the shaft 26 but pulley 32 is eccentrically supported on such shaft.

Body portion 10 of the bow has an integral rearwardly extending arm 34 supporting an anchor belt 36 thereon, this bolt being adjustable in length of a purpose to be described.

One end of the bowstring 38 is secured to an anchor point 40 on pulley 28. The bowstring then extends from such anchor point counterclockwise a substantial distance around this pulley, FIG. 3, and from there it extends in a main span **38*a* up to and around pulley 24 and then back down in an end span 38*b* to pulley 30. This second end portion is wrapped around pulley 30 in the same direction as the other end is on pulley 28 and is similarly secured to an anchor point on pulley 30. Conventional length adjustment means 42 is provided in the bowstring. Bowstring 38 has a nocking point 44 in the span 38*a*. The span 38*a* of the bowstring, being mounted on pulley 28**, is centered laterally of the bow.

A link, such as flexible cable 46, has one end connected to the anchor bolt 36 and its other end leads into the left side of pulley 32 and is connected to an anchor point 48 on this pulley.

The link operatively connects the pulley 32 to the body portion through an arm 34 and the varying tension developed in the link during drawing movements of the bow influences the flexing of the arms.

Anchor bolt 36 is adjustable to provide means to adjust the length of link 46 and consequently the rotation of eccentric pulley 34. This provides an easy method of tensioning the bow and adjusting the draw length.

In a draw movement of the bowstring, namely, from the full line position of FIG. 1 to the broken line position, pulley 24 rotates clockwise and pulley assembly 28, 30 and 32 rotates counterclockwise. When the link 46 swings closer to the shaft 26 with relation to a line extending between such shaft and its anchor point on bolt 36, a break-over occurs and the draw force on the bowstring is relaxed. Furthermore, as the bowstring is drawn, tension buildup in arm 18 is greater than in arm 16.

One feature of the present pulley arrangement is that it is designed for use on bows having one arm which flexes more than the other arm. The arms may comprise a flexible arm and a stiff or substantially stiff arm, or a pair of arms wherein one arm flexes substantially more than the other during a draw of the bow. For the purpose of illustrating this bow structure, arm 18 is shown as comprising the arm that flexes more than the other arm. For simplifying bow structure and decreasing the cost, the arm 16 for example may be substantially stiff or only have minimum flexibility to satisfy certain regulations. Regardless of the relative flexibility of the two arms, the arm 18 according to the invention will flex more than arm 16. At any rate, by means of the compensating action of the pulleys the nocking point 44 will always remain in the same plane relative to the arrow shelf, 14 namely, the nocking point in all drawing movements of the bowstring will be maintained substantially in alignment with the guiding path provided for a projectile by the arrow shelf. Thus, even though more line in the span 38*a* of the bowstring reels over the pulley 24 in a drawing movement than over the pulley 28 due to the greater flexing of arm 18 than arm 16, the nocking point moves rearwardly in substantial alignment with the arrow shelf 14. More particularly, it is apparent that since the arm 18 flexes more than arm 16 during a draw, the nocking point 44 would raise relative to the arrow shelf if means were not present to compensate for this movement. In the present pulley arrangement, however, the upward movement of the pulley assembly 28, 30 with the tip of the arm 18 also shortens the bowstring span 38*b* and this shortening dimension acts on pulley 24 and on pulley assembly 28, 30 to cancel upward movement of nocking point 44.

The leverage of bowstring 38 can be controlled by changing the diameters of pulleys 28 and 30 and eccentric 32 to influence the flexing of the arms.

With reference to FIGS. 4 and 5, an embodiment is provided utilizing a body portion 10' of the same structure as shown in FIG. 1. This embodiment also has a top arm, not shown, and a bottom arm 18' that flexes more than the top arm. Furthermore, this embodiment has an integral arm 34' extending rearwardly from the body portion. The top arm has an identical pulley 24, not shown, as in FIG. 1 but the pulley assembly at the other end comprises merely a double pulley 50 mounted on shaft 26'. In this embodiment both ends of the bowstring are connected to the flexible arm 18' at anchor point 52 and extend over a pulley 54 having eccentric support on a shaft 56 mounted on the arm 34'. The bowstring extends over upper pulley 24 the same as in FIG. 1. Such bowstring may extend with both ends over pulleys 50 and 54 or may be combined into a single line from the pulleys 50 and therebeyond. The ends of the bowstring may also be anchored to the pulleys 50 and a separate line or cable run from an anchor point on one of the pulleys over pulley 54 and then be anchored at 52.

In the drawing movement of the bowstring, the pulleys 50 rotate counterclockwise as viewed in FIG. 4. In such drawing movement, the arm 18' flexes a greater amount than the other arm and and when the line from pulley 54 to anchor point 52 swings closer to the shaft 56, break-over for the bowstring occurs to ease the drawing force required in final portions of the draw. As in the FIG. 1 embodiment, the greater flexing of the arm 18' causes a greater movement of the bowstring over pulley 24 than over pulleys 50, and the upper and lower distances between the nocking point and the tips of the bow in their rest position will remain substantially equal to maintain the nocking point approximately in alignment with the arrow shelf as the bowstring is drawn. An anchor point 58 is provided for the bowstring on pulley 54 to prevent slippage on the pulley. Pulley 54 also could be positioned on the upper arm with a suitable bracket and shaft 56 rather than on a separate arm 34'.

Pulleys 28 and 30 or the two pulleys 50 are of similar diameter to accomplish the intended purpose. Mounting of these pulleys on the bow is such that the span 38*a* of the bowstring is properly aligned laterally with the arrow shelf. Although pulleys 28 and 30 or 50 could be combined into a single pulley and engaged by both ends of the bowstring, the two-pulley arrangement or double groove shown in preferred since the spacing as shown offsets the two vertical spans 38*a* and 38*b* of the bowstring and arrows can be shot by the span 38*a* without interference from the span 38*b*. Pulley 24 can be of any size on these embodiments but preferably it is enlarged sufficiently such that a good front to rear space is provided between the bowstring spans to allow the archer to readily place an arrow on the nocking point.

A further form of the invention is shown in FIG. 6 and 7. This structure has the same basic bow structure as in FIG. 1 but instead of using a single pulley on arm 16, pulley 24' has a double groove. The span 38*a* of the bowstring extends from the pulley 28 to the left groove in pulley 24' and from there the bowstring extends in a counterclockwise direction, FIG. 6, around at least a substantial distance of pulley 24'. It then crosses through a diagonal aperture 62 in the pulley 24' to the other groove and exits into bowstring span 38*b*. The double pulley arrangement of FIGS. 6 and 7 provides a good lateral offset between the spans 38*a* and 38*b* for arrow clearance.

According to the invention, a simplified compound type bow is provided that is capable of using an arm arrangement where one arm flexes more than the other and accuracy in shooting is still maintained. The bow arms thus do not have to be tuned to each other, thus simplifying and reducing cost of manufacture. The bow arms can be reversed in position, namely, the arm which flexes more can be on the top rather than on the bottom.

It is to be understood that the forms of my invention herein shown and described are to be taken as preferred examples of the same and that various changes in the shape, size and arrangement of parts may be resorted to without departing from the spirit of my invention, or the scope of the subjoined claims. For example, arrow shelf 14 may be a device such as a pin and still provide a guiding path for the projectile. Also, the link 46 in FIG. 1 could be adjustably anchored to the frame instead of to the arm 34 and have guided movement over an outer portion of the arm, the support arm 34 could be shortened or deleted and link 46 anchored to the shortened arm or the body portion, and pulley 32 could be concentrically supported by shaft 26.

Having thus described my invention, I claim:

1. An archery bow comprising (a) a body portion, (b) a bowstring on said bow movable rearwardly in drawing movements of the bow, (c) said bowstring including a main span and an end span, (d) a nocking point on said main span of said bowstring, (e) projectile guide means on said body portion providing a projectile guiding path which extends rearwardly at substantially a right angle to said body portion, (f) first and second oppositely extending bow arms on said body portion having tip ends, (g) said first arm flexing substantially more than said second arm during drawing movements of the bowstring main span, (h) bowstring guide means comprising a first rotatable guide member on said first arm tip end and a second rotatable guide member on said second arm tip end, (i) said second guide member comprising a rotatable pulley supported on said second arm tip end by a centrally located axis for non-eccentric rotation, (j) said first rotatable guide member and said rotatable pulley having opposite bowstring engaging sides, (k) said projectile guiding path being substantially in rearward alignment with said nocking point in a rest position of the bow, (l) said main span of said bowstring extending between said bow arm tip ends and engaging said first rotatable guide member on the first arm tip end and said rotatable pulley on the second arm tip end, (m) said main span of said bowstring wrapping over said rotatable pulley on the second arm tip end, (n) said end span of said bowstring extending from said rotatable pulley on the second arm tip end to said first rotatable guide member on the first arm tip end, (o) both said main and end spans wrapping around said first rotatable guide member in a common direction so that during operation of the bow a rearward drawing movement of said main span will cause said main span and said end span to urge rotation of said rotatable first guide member and also will cause more of said bowstring main span to reel over said rotatable pulley on the second arm tip end than over said first rotatable guide member on the first arm tip end to compensate for the difference in flexing of the arms and to provide a rearward draw of said bowstring which maintains the nocking point in all of such draw movement substantially in rearward alignment with the projectile guiding path provided by said projectile guide means.

2. The archery bow of claim 1 wherein said bowstring guide means includes a pulley on each of said arms, said pulleys supported by centrally located axes for non-eccentric rotation, and an eccentric means comprising a pulley eccentrically secured to one of said pulleys.

3. The archery bow of claim 1 wherein said bowstring includes end portions, said end portions terminating on the same arm.

4. The archery bow of claim 1 wherein said first rotatable guide member comprises a double pulley engageable by respective main and end spans of said bowstring.

5. The archery bow of claim 1 wherein said bowstring guide means also includes a rotatable eccentric member positioned on said first arm, said rotatable eccentric member being secured to said first rotatable guide member for rotation in unison, said eccentric member producing variable tension in said bowstring to control the bowstring tension force thereof while shooting a projectile.

6. The archery bow of claim 1 wherein said end span operatively engages said first guide member on substantially the same side as the engagement of said main span with said first guide member.

7. The archery bow of claim 1 wherein said main span and said end span terminate on the same guide member.

* * * * *